US007836624B1

(12) United States Patent
Pennington

(10) Patent No.: US 7,836,624 B1
(45) Date of Patent: Nov. 23, 2010

(54) GUN CLEANING KIT

(76) Inventor: Billy Pennington, 414 S. Pulaski St., Suite 1, Little Rock, AR (US) 72201

( * ) Notice: Subject to any disclaimer, the term of this patent is extended or adjusted under 35 U.S.C. 154(b) by 0 days.

(21) Appl. No.: 11/745,436

(22) Filed: May 7, 2007

Related U.S. Application Data

(60) Provisional application No. 60/746,581, filed on May 5, 2006.

(51) Int. Cl.
*F41A 29/02* (2006.01)

(52) U.S. Cl. ..... 42/95

(58) Field of Classification Search ..... 42/95, 42/96; 15/104.2, 104.53
See application file for complete search history.

(56) References Cited

U.S. PATENT DOCUMENTS

| | | | | | |
|---|---|---|---|---|---|
| 139,633 | A * | 6/1873 | Turner | 15/104.19 |
| 486,331 | A * | 11/1892 | Garrison | 42/95 |
| 849,786 | A * | 4/1907 | Hildenbrand | 15/104.19 |
| 1,237,056 | A * | 8/1917 | Kitchen | 15/104.16 |
| 2,805,434 | A * | 9/1957 | Hopkins | 15/104.16 |
| 3,208,302 | A * | 9/1965 | Lewis et al. | 42/95 |
| 3,609,790 | A * | 10/1971 | Butch | 15/104.165 |
| 4,195,381 | A * | 4/1980 | Jurich, III | 15/104.2 |
| 4,399,627 | A * | 8/1983 | Malesky et al. | 42/95 |
| 4,674,218 | A * | 6/1987 | Bottomley | 42/95 |
| 4,716,673 | A * | 1/1988 | Williams et al. | 42/95 |
| 4,899,415 | A * | 2/1990 | Wheeler | 81/438 |
| 4,901,465 | A * | 2/1990 | Hsu | 42/95 |
| 5,328,122 | A * | 7/1994 | Yamaguchi | 16/422 |
| 6,205,602 | B1 * | 3/2001 | Dettweiler | 81/23 |
| 7,020,994 | B2 * | 4/2006 | Buie, II | 42/95 |
| 2003/0091401 | A1 * | 5/2003 | Thompson | 408/221 |
| 2006/0010753 | A1 * | 1/2006 | Buie | 42/95 |

OTHER PUBLICATIONS

Handle. (2010). Merriam-Webster Online Dictionary. Retrieved Jul. 23, 2010, from http://www.merriam-webster.com/dictionary/handle.*

* cited by examiner

*Primary Examiner*—Michael Carone
*Assistant Examiner*—Jonathan C Weber
(74) *Attorney, Agent, or Firm*—Crossley Patent Law; Mark A. Crossley

(57) ABSTRACT

The present Gun Cleaning Kit is designed to be clean various sizes of gun barrels. The present Gun Cleaning Kit comprises a universal gun cleaning kit with an elongate rod rotatably mounted to a handle.

11 Claims, 1 Drawing Sheet

GUN CLEANING KIT

Be it known that I, Billy Pennington, a citizen of the United States, have invented new and useful improvements to a Gun Cleaning Kit as described in this specification. This application claims the benefit of my earlier filed provisional application No. 60/746,581 filed on May 5, 2006.

BACKGROUND OF THE INVENTION

Various gun cleaning kits used to clean the barrel of a gun have been provided in prior art. A conventional gun cleaning kit generally has an elongate rod having a handle at one end and a gun barrel cleaning element at an opposite end. The rod, which is typically multi-sectioned, can be dissembled for storage. Furthermore, the top section of the rod is generally rotatable in the handle to prevent scratching the inside of a gun barrel and to prevent accessories from unscrewing and detaching inside the barrel.

Gun cleaning kits, which include the foregoing features, are provided which accommodate different size gun barrels. Because the handle of a rod is typically fixedly attached to the top section of a rod, different handles must be provided for each rod set.

The present Gun Cleaning Kit addresses one or more of the problems presented by prior art gun cleaning kits in a novel manner without many of the disadvantages of any existing gun cleaning kits.

SUMMARY OF THE INVENTION

The present Gun Cleaning Kit is designed to be clean various sizes of gun barrels. The present Gun Cleaning Kit comprises a universal gun cleaning kit with an elongate rod rotatably mounted to a handle. Said handle is generally belt-shaped and comprises a large female threaded receiver on a top side and a smaller female threaded receptacle on an opposite, bottom side. Said rod has opposite near and distal ends. The distal end is adapted for selectively receiving a gun barrel cleaning element. A shaft operatively connects the rod to the handle with a first end rotatably mounted to the rod near end and a second end being selectively threaded into either the receiver or the receptacle so that the rod is rotatable relative to said handle.

Both the threaded receiver and receptacle of said handle further comprise a counterbore and a metal receptacle fixedly mounted in said counterbore. The metal receptacle includes a threaded bore defining the threaded receiver and the threaded receptacle. A male threading element of the shaft according to the present Gun Cleaning Kit is of smaller diameter than the threaded receiver and, also, the threaded receptacle. In other words, the male threaded element is of a select size to be threadably received in the female receiver and the female receptacle. The shaft includes an outwardly opening annular groove and the rod near end is telescopically received on the shaft and has an inwardly extending annular ridge received in the groove. In addition, the rod is telescopically mounted to the shaft and further comprising a groove therebetween in at least one of the shaft and the rod and a bearing is received in the groove to rotatably mount the shaft to the rod.

There is disclosed in accordance with another aspect of the invention a universal gun cleaning kit including a universal handle including a female threaded opening of a first select size. A plurality of elongate rods have different outer diameters. Each rod has opposite near and distal ends. The distal ends are adapted for selectively receiving a gun barrel cleaning element. A plurality of shafts are each rotatably connected to an associated one of the rods. The shafts include a male threaded end of the first select size or a second select size. Because the handle comprises both a smaller female threaded receiver and a larger female threaded receptacle, there is no need for an adaptor to accommodate various sized rods.

Further features and advantages of the invention will be readily apparent from the specification and from the drawings.

DETAILED DESCRIPTION OF THE DRAWINGS

Figures 1, 2, 3, 4, 5:
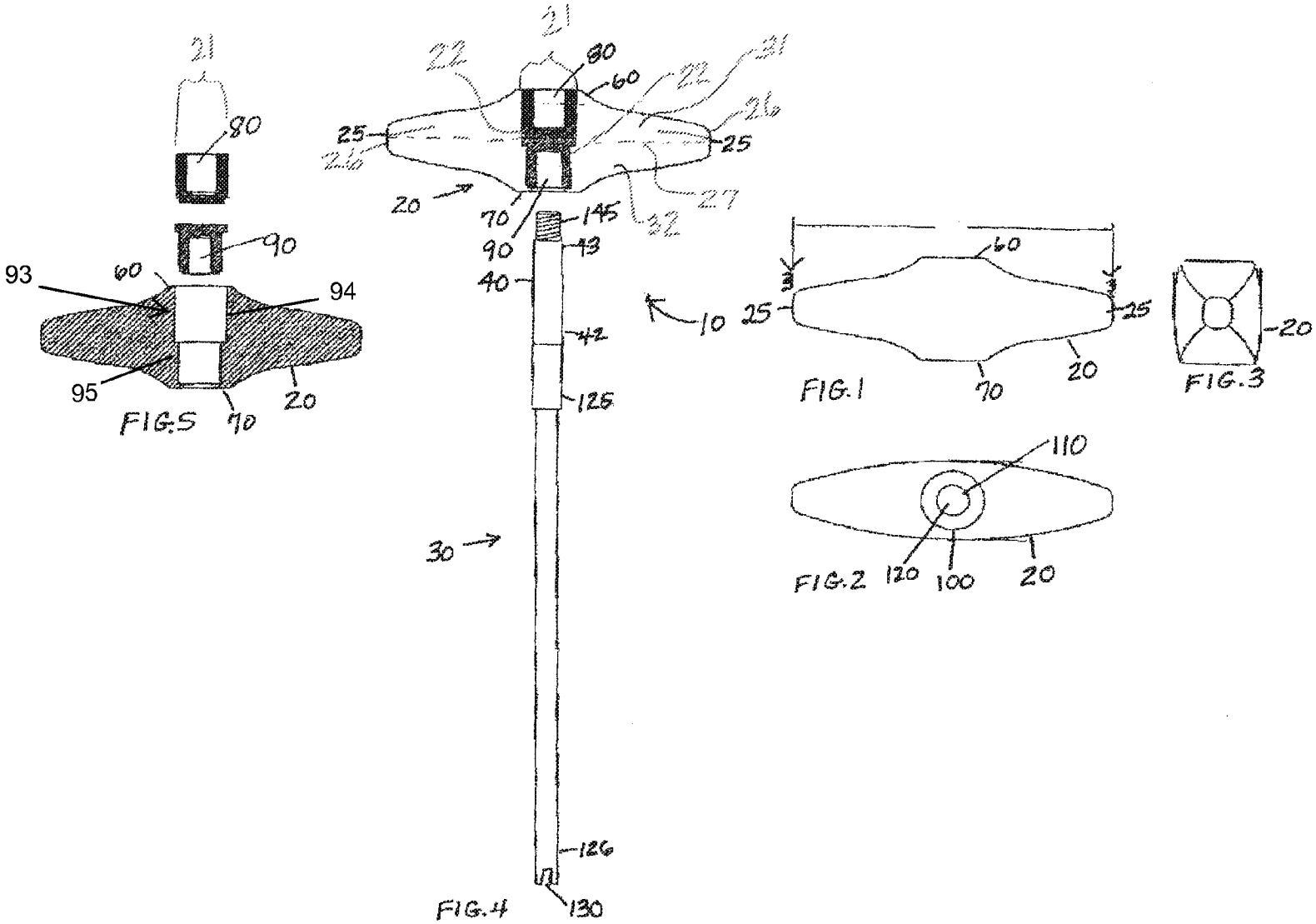
FIG. 1 is a front elevation view of a handle.
FIG. 2 is a side elevation view of a handle.
FIG. 3 is a top plan view of a handle taken along line 3-3 of FIG. 1.
FIG. 4 is an exploded cross-sectional of a handle.
FIG. 5 is an exploded side elevation of a rod and a cross-sectional of a handle.

The present invention relates to a universal gun cleaning kit including a universal handle for use with various size rods for cleaning, for example, .17 cal. bores, .22 cal. bores, .30 cal. bores and shotguns. The rods are removably and rotatably attached to the handle in order to allow for long term use of the present kit.

Referring generally to FIG. 1 through FIG. 5, the present universal Gun Cleaning Kit 10 (shown in FIG. 4) is comprised of an elongate telescopic rod 30 (shown in FIG. 4) rotatably mounted to a handle 20 (illustrated in FIGS. 1, 2, 3, and 4), and a shaft 40 connected to said rod 30. Said handle 20 has a horizontal width greater than a vertical width. Said handle 20 includes a center section 21 having a top 60 and a bottom 70. The center section 21 has a rectangular cross-section. A cavity 93 formed in the center section 21 extends from the top 60 of the center section 21 to the bottom 70 of the center section 21 such that the cavity 93 opens on the top 60 and the bottom 70 of the center section 21. The cavity 93 has a first portion 94 with a first width at the top 60 of the center section 21 and a second portion 95 with a second width at the bottom 70 of the center section 21. Said handle 20 has two opposing elongated campanular ends 25 as illustrated in FIGS. 1 and 5. Each end 25 has a base 22 adjacent to the center section 21 and also has a distal apex 26. A horizontal midline 27 is disposed between the apices 26, the midline defining generally mirror-image upper and lower portions 31, 32. Said handle 20 has a top 60 and a bottom 70 as shown in FIG. 1. Said top 60 of handle 20 center section 21 comprises an outwardly opening receiver 80 (as shown in FIG. 5) integrated into the handle 20 center section 21 top 60. Said bottom 70 of handle 20 center section 21 comprises an outwardly opening receptacle 90 (as shown in FIG. 5) integrated in the handle 20 center section 21 bottom 70. A threaded receiver 80 is disposed in the first portion 94 of the cavity 93 of the center section 21 and is integrated in the handle 29 center section 21 top 60 wherein the threaded receiver 80 has a first exterior width corresponding to the first width of the first portion of the cavity 93. A threaded receptacle 90 is disposed in the second portion 95 of the cavity 93 of the center section 21 and integrated in the handle 20 center section 21 bottom 70 wherein the threaded receptacle 90 has a second exterior width corresponding to the second width of the second portion 95 of the cavity 93. The threaded receiver 80 and the threaded receptacle 90 have different interior diameters. The interior diameter of the receiver 80 corresponds to the diameter of a first one of the at least two cleaning rods 30 and the interior diameter of the receptacle 90 corresponds to the diameter of a second one of the at least two cleaning rods 30. Each of the receiver 80 and the receptacle 90 selectively removably and threadingly receive one of the at least two gun cleaning rods 30. Said holder 100 includes a threaded bore 110 to define threaded opening 120.

In the illustrated embodiment of the present gun cleaning kit 10, the holder 100 may be formed of brass molded in situ into the top 60 and bottom 70 or secured by friction fit or an adhesive. The use of a holder 100 minimizes stripping of the threads in the threaded opening 120. The threaded opening 120 of the receiver 80 comprises a female threaded opening of a first select size. The threaded opening 120 of the receptacle 90 comprises a female threaded opening of a second select size. In an exemplary embodiment, the threaded opening 120 of a receiver 80 may be on the order of ¼ inch diameter, while the threaded opening 120 of a receptacle 90 may be on the order of 3/16 inch diameter. The provision of a threaded opening 120 in both the receiver 80 and the receptacle 90 provides a universal gun cleaning kit 10 in which different size rods 30 can be used without the necessity of providing an adapter.

The rod 30 comprises an elongate metal rod having a near end 125 with a shaft 40 and an opposite distal end 126 (as shown in FIG. 5). The rod 30 comprises a three-sectioned rod, each section is threadably connected to another to provide a rod approximately thirty-two inches long. However, the rod 30 could be a one piece or two piece rod of any known length. The use of more pieces in the rod allows for easier storage since the pieces are threadably separable. Also, depending on the length of the barrel to be cleaned, a differing number of pieces may be removably threaded together.

The shaft 40 (shown in FIG. 5) is provided for rotabably connected the rod 30 to the handle 20. The shaft 40 includes a first end 42 rotatably mounted to the rod 30 near end 125 and a second end 43 comprising a male threaded element 145. Said male threaded element 145 is of a size to be threadably received in the female threaded receiver 80 or the female threaded receptacle 90.

Said shaft 40 is a machined part. In an exemplary embodiment of the present universal gun cleaning kit 10, the shaft 40 is of brass construction and is machined so that the first end 42 of said shaft 40 may be rotatably mounted to the rod near end 125 and the male threaded element 145 may be threadably received in the female receiver 80 or the receptacle 90.

Thus, in accordance with the present universal gun cleaning kit 10, a plurality of different size rods can be used with a single universal handle 20 with each rod being rotatably mounted to the handle 20.

What is claimed is:

1. A gun cleaning kit comprising:

at least two gun cleaning rods, each of the cleaning rods having a different diameter and a threaded end;

a universal handle having a horizontal width greater than a vertical width, the handle comprising:

a center section having a top and a bottom;

a pair of opposing elongated campanular ends, each end having a base adjacent to the center section and a distal apex;

a horizontal midline disposed between the apices, the midline defining generally mirror-image upper portion and lower portions;

a cavity formed in the center section, the cavity extending from the top of the center section to the bottom of the center section such that the cavity opens on the top and the bottom of the center section, the cavity having a first portion with a first width at the top of the center section and a second portion with a second width at the bottom of the center section;

a threaded receiver disposed in the first portion of the cavity of the center section and integrated in the handle center section top, the receiver having a first exterior width corresponding to the first width of the first portion of the cavity;

a threaded receptacle disposed in the second portion of the cavity of the center section and integrated in the handle center section bottom, the receptacle having a second exterior width corresponding to the second width of the second portion of the cavity;

the threaded receiver and the threaded receptacle having different interior diameters, the interior diameter of the receiver corresponding to the diameter of a first one of the at least two cleaning rods and the interior diameter of the receptacle corresponding to the diameter of a second one of the at least two cleaning rods;

wherein each of the receiver and the receptacle selectively removably and threadingly receive one of the at least two gun cleaning rods.

2. The gun cleaning kit of claim 1 wherein the receiver and the receptacle receive a rod sized to clean a gun having a bore selected from the group comprising .17 caliber, .22 caliber, and .30 caliber.

3. The gun cleaning kit of claim 1 wherein the at least two rods comprises three rods of different diameters, wherein the rod is telescopic such that a length of the rod is adjustable.

4. The gun cleaning kit of claim 1 wherein the center section has a rectangular cross-section.

5. The gun cleaning kit of claim 1 wherein a shoulder is formed in the cavity between the first and second portions of the cavity.

6. The gun cleaning kit of claim 5 wherein the shoulder is located approximately midway between the top and the bottom of the center section.

7. The gun cleaning kit of claim 5 wherein one of the receiver and the receptacle includes an radially outwardly extending rim extending substantially continuously along a circumference of the one of the receiver and the receptacle to rest against the shoulder.

8. The gun cleaning kit of claim 5 wherein the first portion of the cavity is located between the shoulder and the bottom of the center section and the second portion is located between the shoulder and the top of the center section.

9. The gun cleaning kit of claim 1 further comprising a holder fixedly mounted in each of the receiver and the receptacle, the holder comprising a threaded bore having a female threaded opening, the holder comprising a metal to minimize stripping of the threads in the threaded opening.

10. The gun cleaning kit of claim 1 wherein the receiver and the receptacle receive a rod sized to clean a gun having a bore selected from the group comprising .17 caliber, .22 caliber, and .30 caliber;

wherein the at least two rods comprises three rods of different diameters, wherein the rod is telescopic such that a length of the rod is adjustable;

wherein the center section has a rectangular cross-section;

wherein a shoulder is formed in the cavity between the first and second portions of the cavity;

wherein the shoulder is located approximately midway between the top and the bottom of the center section;

wherein one of the receiver and the receptacle includes an radially outwardly extending rim extending substantially continuously along a circumference of the one of the receiver and the receptacle to rest against the shoulder;

wherein the first portion of the cavity is located between the shoulder and the bottom of the center section and the second portion is located between the shoulder and the top of the center section; and a holder fixedly mounted in each of the receiver and the receptacle, the holder comprising a threaded bore having a female threaded opening, the holder comprising a metal to minimize stripping of the threads in the threaded opening.

11. A gun cleaning kit consisting of:

a universal handle having a horizontal width greater than a vertical width, the handle consisting of a center section having a top, and a bottom, and a rectangular cross-section a pair of opposing elongated campanular ends, each end having a base adjacent to the center section and a distal apex;

a horizontal midline disposed between the apices, the midline defining generally mirror-image upper portion and lower portions;

a cavity formed in the center section, the cavity extending from the top of the center section to the bottom of the center section such that the cavity opens on the top and the bottom of the center section, the cavity having a first portion with a first width at the top of the center section and a second portion with a second width at the bottom of the center section;

a threaded receiver disposed in the center section between the ends and integrated in the handle center section top;

an opposing threaded receptacle disposed in the center section and integrated in the handle center section bottom;

the threaded receiver and the threaded receptacle having different diameters.

* * * * *